United States Patent [19]

Curletto

[11] Patent Number: 4,953,436

[45] Date of Patent: Sep. 4, 1990

[54] FOLDING HOUSING FOR ELECTRONIC M.I.D.I. ACCORDION

[76] Inventor: Giorgio F. Curletto, 6109 Nevada Ave. NW., Washington, D.C. 20015

[21] Appl. No.: 422,757

[22] Filed: Oct. 16, 1989

[51] Int. Cl.[5] ..... G10D 11/00

[52] U.S. Cl. ..... 84/376 A; 84/352

[58] Field of Search ..... 84/177, 352, 376 R, 84/376 A

[56] References Cited

U.S. PATENT DOCUMENTS 1,577,680 3/1926 Bilhorn ..... 84/352

4,545,276 10/1985 Curletto ..... 84/376 A 4,884,488 12/1989 Curletto ..... 84/376 R

FOREIGN PATENT DOCUMENTS 241432 3/1946 Switzerland ..... 84/376 A

*Primary Examiner*—Lawrence R. Franklin

[57] ABSTRACT

A folding housing for electronic M.I.D.I. accordion without bellows and without reeds. It is a portable musical instrument which is extremely light to strap on and to handle and it becomes even more attractive when traveling because of its folding feature which reduces its size in half making it an ideal carry-on piece of luggage which can go with you on a plane and fit either under the seat or in the over head compartment.

1 Claim, 1 Drawing Sheet

FOLDING HOUSING FOR ELECTRONIC M.I.D.I. ACCORDION

BRIEF SUMMARY OF THE INVENTION

The folding housing for electronic M.I.D.I. (Musical Instrument Digital Interface) accordion is the product of my continuing effort as a professional accordionist, to create, for the modern and progressive electronic accordion players, a housing for the electronic M.I.D.I. accordion which is remarkably light to perform with and extremely convenient to carry and to handle when traveling by any means of transportation. Once the folding housing for electronic M.I.D.I. accordion is folded in half, it becomes at least half the size of the existing traditional electronic M.I.D.I. accordion, and therefore, on an airplane it can be stored either under the seat like a carry-on luggage or in the over-head baggage container.

Besides the advantages that I have just set forth, the folding housing for electronic M.I.D.I. accordion, allows the accordionist to regulate and select the curvature of the instrument to whichever degree that may best adhere to his or her own body's contour so that additional comfort and better balanced weight distribution be ultimately achieved.

The thumb screw-like device that makes the aforesaid adjustments possible, is located on the top surface of the rectangular metal brace which on one side is connected to the bassboard housing and on the other side is linked by means of a piano hinge to the short extension which constitutes the keyboard housing.

The folding housing for electronic M.I.D.I. accordion retains the traditional bassboard strap. However only one back strap is needed in lieu of the two shoulder straps traditionally used in the electronic accordions.

The folding housing for electronic M.I.D.I. accordion opens and closes in a semicircular inverted fan-like radius and comprises one control panel consisting of one single row of preset buttons arranged longitudinally on a narrow surface adjacent to the inner edge of the keyboard.

A BRIEF DESCRIPTION OF THE SEVERAL VIEWS OF THE DRAWINGS

Enclosed are three drawings that I refer to as FIG. 1, FIG. 2, and FIG. 3.

FIG. 1 shows the front and top views of the folding housing for electronic M.I.D.I. accordion which include Part 2 (the only control panel with its preset switches) and Part 4, the frontal section of the rectangular metal brace displaying a number of little dots that are representing the heads of the screws connecting the rectangular metal brace to the bassboard housing.

FIG. 2 offers a back view of the instrument revealing Part 6 (one of the two attachments of the single backstrap which takes the place of the two traditional shoulder straps) and Part 17, FIG. 2, the second attachment of same single backstrap. FIG. 2 also makes visible Part 8 and Part 11 (the two cavities through which the wires connecting the bassboard to the keyboard are channeled).

Part 13, FIG. 2, is the instrument's main plug. Part 9, FIG. 2, is the piano hinge that makes the two halves of the folding housing adjustable at different degrees of angle. Part 18, FIG. 2, is the thumb screw-like device that revolves within Part 19, FIG. 2 (the cavity located on Part 16, FIG. 2 which is the top short partially tapered section of the rectangular metal brace) and interacts with Part 21, FIG. 2 (the short semicircular sequence of perforations arranged on the short top end surface of the keyboard's housing) that functions as a guage of sort to lock into position the precise degree of angle desired of both the keyboard and bassboard.

FIG. 3 ultimately presents the instrument fully folded and ready for storage or travel.

DETAILED DESCRIPTION OF THE FOLDING HOUSING FOR ELECTRONIC M.I.D.I ACCORDION

Figure 1:
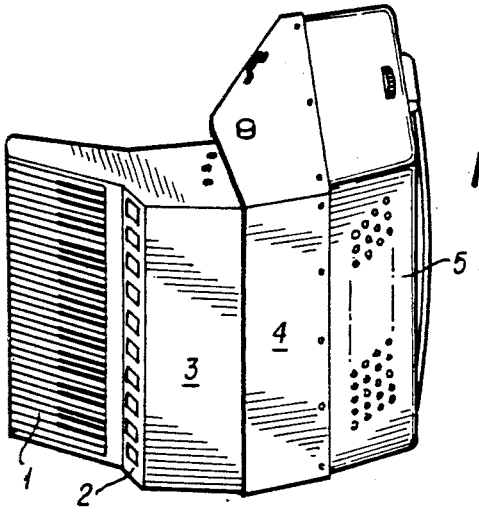

The folding housing for electronic M.I.D.I. accordion retains a standard accordion keyboard which extends lengthwise, into a short rectangular protuberance, and a complete standard bassboard housing assembly (Part 1 and Part 5, FIG. 1 in that order).

As FIG. 1 shows, Part 2 is the only control panel of the folding housing for electronic M.I.D.I. accordion and such control panel is bordering longitudinally, on one side, with the inner edge of the keyboard and on the opposite side it merges lengthwise with Part 3, FIG. 1, the rectangular frontal panel of the very short rectangular protuberance which constitutes the keyboard housing. The subsequent opposite longitudinal edge of said rectangular frontal panel of Part 3, FIG. 1, also merges lengthwise with Part 7, FIG. 2 (the rectangular narrow end panel of the keyboard housing), the whole length of which is connected, by means of a piano hinge of almost equal length (Part 9, FIG. 2), to Part 20, FIG. 2 (the back side of the first one of the two longitudinal edges of the frontal surface of the rectangular central metal brace (Part 4, FIG. 1).

Figure 2:
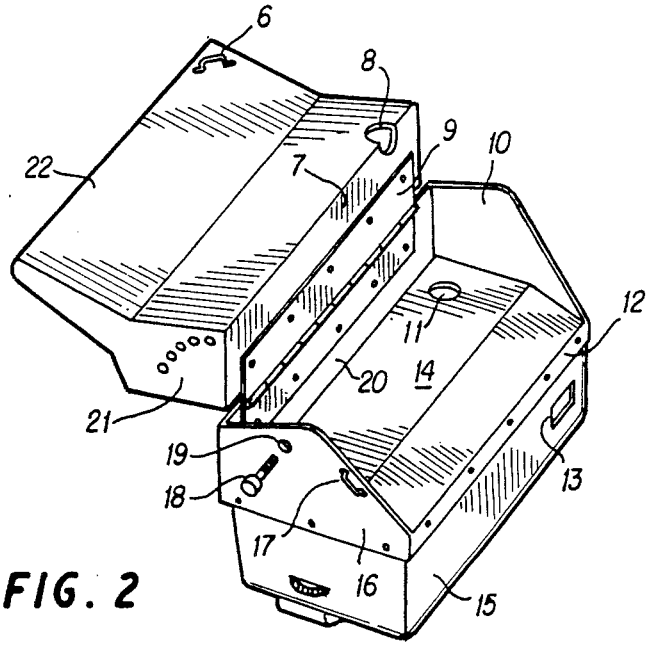

The rectangular metal brace which represents the central section of the folding housing for electronic M.I.D.I. accordion that links the keyboard housing (Part 3, FIG. 1) to the bassboard housing (Part 5, FIG. 1), consists of four surfaces as indicated in FIG. 2 by Part 10, Part 12, Part 16, and Part 20.

Part 20, FIG. 2 which is the back side of Part 4, FIG. 1 (the frontal surface of the rectangular metal brace), consists of a rectangular surface about 3¼" wide, Part 12, FIG. 2, is the back surface of the rectangular metal brace and it is clearly a much narrower surface (about 1" wide) only needed for the basic purpose of bracing the back surface of the bassboard housing (Part 15, FIG. 2), by means of properly spaced screws (as indicated by the little dots on Part 12, FIG. 2), without protruding beyond the surface of Part 14, FIG. 2 (the inner side panel of the bassboard housing), so that the back side of the keyboard (Part 22, FIG. 2), may fully adhere to said inner side panel of the bassboard housing (Part 14, FIG. 2), in a completely closed position.

Figure 3:
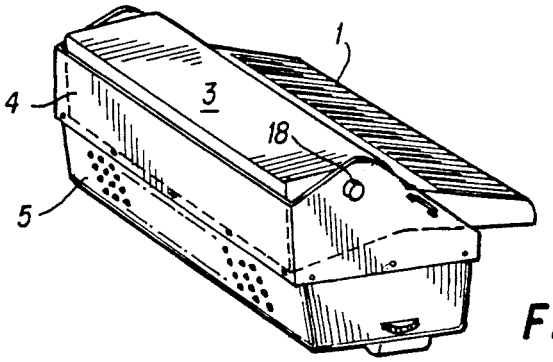

Once the rectangular metal brace is tightly connected by one of its two rectangular open ends to the four inner sides of the matching rectangular bassboard housing, the frontal surface of the rectangular metal brace (Part 4, FIG. 1) and the shorter partially tapered top and bottom surfaces (Part 16 and Part 10, FIG. 2), provide a trilateral screen that protects and shields the keyboard as FIG. 3 clearly shows and furthermore, it conceals the piano hinge action and also safeguards the wires which connect the keyboard housing to the bassboard housing.

The shape of the cavity identified as Part 8, FIG. 2, is carved out of two distinctive surfaces (Part 7, FIG. 2), the rectangular side panel of the short protuberance which represents the keyboard housing and the back surface of the keyboard housing which is directly behind Part 3, FIG. 1. This cavity, together with the second cavity Part 11, FIG. 2, located on Part 14, FIG. 2 (the inner side panel of the bassboard housing), provides the necessary amount of clearance required by the aforesaid connecting wires, not to obstruct the opening and closing action of the two halves of the folding housing, and most of all to allow the wires to remain unobstructed and totally free even in a fully closed position of the instrument.

Part 13, FIG. 2 is the main plug of the folding housing for electronic M.I.D.I. accordion and it's positioned on the lower left corner of the bassboard housing's back surface.

Part 17 and Part 6, FIG. 2, are the top and bottom attachments, in that order, of the single back strap required by the folding housing for electronic M.I.D.I. accordion. Said single strap is fastened, at one end, to the top attachment (Part 17, FIG. 2) and it's worn over the left shoulder and down across the back and hugging the right side of the accordionist's waist line, to then immediately hook up to Part 6, FIG. 2 (the second attachment located on the lower right corner of the back surface of the keyboard).

The short top tapered surface of the rectangular metal brace (Part 16, FIG. 2), provides the cavity (Part 19, FIG. 2) through which the thumb screw-like manual control (Part 18, FIG. 2) operates. Said manual control extends into a very short machine screw stem which interacts with matching machined perforations arranged directly beneath said short machine screw stem, in a semicircular sequence (Part 21, FIG. 2) located on the top end surface of the rectangular protuberance of the keyboard housing, to create a regulating gauge that allows to select and lock into position the degree of angle desired with regard to both the keyboard and the bassboard, by simply turning said thumb screw to the right to lock and by turning same to the left to unlock and change position. The revolving action of the two halves of the folding housing, takes place within the radius of a 45° angle and the two halves move within such radius in an inverted fan-like fashion resulting in a semicircular limited motion.

I claim:

1. A folding housing for electronic M.I.D.I. accordion, said folding housing consisting of a complete electronic M.I.D.I. accordion bassboard housing, said bassboard housing being connected on one side by the extreme inner edges of its long front and back surfaces and its short top and bottom surfaces to a matching rectangular metal brace comprising a long wide frontal surface, an equally long but considerably narrower back surface, a short partially tapered top surface and a similarly short partially tapered bottom surface, and one electronic M.I.D.I. accordion keyboard extending, lengthwise, into a very short rectangular protuberance having a long narrow front surface, a long narrow back side, a short top end (containing a semicircular sequence of perforations) and a short bottom end and a long rectangular narrow side panel sealing the opening of said very short rectangular protuberance, said long rectangular narrow side panel of said electronic M.I.D.I. accordion keyboard's protuberance being connected, by means of a piano hinge, to the back side of said long wide frontal surface of said rectangular metal brace, said short partially tapered top surface of said rectangular metal brace having a thumb screw-like manual control interacting with said semicircular sequence of perforations to regulate the desired angle of two halves of the folding housing for electronic M.I.D.I. accordion, said short partially tapered top surface of said rectangular metal brace also containing one of the two attachments required by the single back strap and said keyboard housing's back surface having the second of said two attachments of said single back strap fastened to its lower right corner, the control panel being in the shape of a narrow single row of push buttons facing laterally rightward and merging longitudinally, on one side, with the outer edge of said long narrow front surface of said very short rectangular protuberance, and bordering lengthwise, on the opposite side, with the inner edge of said electronic M.I.D.I. keyboard.

* * * * *